US005127996A

United States Patent [19]

Vallius

[11] Patent Number: 5,127,996

[45] Date of Patent: Jul. 7, 1992

[54] METHOD AND DEVICE IN A COMPACT PRESS SECTION FRAME CONSTRUCTION OF A PAPER MACHINE

[75] Inventor: Oiva Vallius, Jyväskylä , Finland

[73] Assignee: Valmet Paper Machinery Inc., Finland

[21] Appl. No.: 713,806

[22] Filed: Jun. 12, 1991

[30] Foreign Application Priority Data

Jun. 15, 1990 [FI] Finland ..... 903004

[51] Int. Cl.[5] ..... D21F 3/04

[52] U.S. Cl. ..... 162/199; 162/200; 162/273; 162/360.2

[58] Field of Search ..... 162/272, 273, 274, 358, 162/360.1, 205, 199, 200

[56] References Cited

U.S. PATENT DOCUMENTS

| | | | |
|---|---|---|---|
| 4,192,711 | 3/1980 | Tapio | 162/272 |
| 4,608,125 | 8/1986 | Avtio | 162/273 |
| 4,657,634 | 4/1987 | Avtio | 162/199 |
| 4,826,572 | 5/1989 | Fukui et al. | 162/360.1 |
| 4,879,002 | 11/1989 | Snellman et al. | 162/360.1 |
| 4,919,762 | 4/1990 | Laapotti et al. | 162/273 |
| 4,942,634 | 8/1990 | Riddick | 162/273 |

*Primary Examiner*—Karen M. Hastings

*Attorney, Agent, or Firm*—Steinberg & Raskin

[57] ABSTRACT

Method and device in a compact press section of a paper machine for balancing of its static and dynamic properties as well as for replacing of the press rolls and fabrics. The press rolls form a compact press roll combination. A space is located in and above the press roll combination between the front and rear frame parts which can be opened and closed. By means of this space at least the upper fabrics and the upper press rolls in the press section are replaced by means of a crane mounted on the ceiling or equivalent, preferably substantially by direct raising and lowering. The front and rear frame parts are interconnected rigidly at and above the press roll combination by means of a rigid intermediate frame part. The intermediate frame part operates as the frame part of the tensioning device of the first upper fabric, and the intermediate frame part together with the upper fabric tensioning device and the tensioning roll. The intermediate frame part may be pivotally connected to the front frame part by means of horizontal articulated joints, or shifted to the side substantially linearly, so that at and above the press roll combination a free open space is opened. This space can be utilized in replacement both of the upper press rolls and of the upper fabrics.

15 Claims, 5 Drawing Sheets

METHOD AND DEVICE IN A COMPACT PRESS SECTION FRAME CONSTRUCTION OF A PAPER MACHINE

FIELD OF THE INVENTION

The invention relates to a frame construction and method in a compact press section of a paper machine for balancing of its static dynamic properties as well as for replacing of the press rolls and fabrics.

BACKGROUND OF THE INVENTION

Various compact and closed press sections are known in the prior art which include a combination of press rolls, whose press rolls form, as a rule, at least three press nips with each other. Examples of such prior art press sections include, for instance, the "Sym-Press II" press section and "Sym-Press 0" press section (trademarks of the assignee, Valmet Paper Machinery Inc.).

In a "Sym-Press II" press section, the first twin-felt nip is formed between a hollow-faced lower press roll and an upper press-suction roll. The suction roll forms a second nip with the smooth-faced center roll of the press. A third press nip is also formed in connection with the center roll.

In a "Sym-Press 0" press section, the first twin-felt horizontal nip is formed between a lower hollow-faced roll and an upper press-suction roll, after which the web follows the upper fabric as a vertical run into a second nip. The second nip is formed between a hollow-faced press roll separate from the rolls of the first nip and the smooth-faced center roll. In connection with the center roll, a third press nip, which is provided with a felt, is formed in conjunction with a hollow-faced press roll.

In compact press sections, the replacement of press fabrics and of heavy press rolls is problematic. To solve these problems, a "QF press frame" (trademark of the assignee, Valmet Paper Machinery Inc.) has been developed. Different versions of the "QF press frame" are known, for example, from published Finnish Patent Applications Nos. 70,951 and 73,025, as well as U.S. Pat. Nos. 4,608,125 and 4,699,692.

In a "QF press frame", the space placed between the front and rear frame parts and at and above the combination of press rolls is arranged open or openable, so that the upper fabric and at least the upper press rolls can be replaced quickly and easily by making use of the open or openable space.

After its introduction, the "QF frame" soon became widely used and commonly accepted because it provided novel solutions for problems that had existed for a long time.

In addition to the above-described "QF frames", a number of other openable frame constructions of a compact press section are known in the prior art.

First, the "Flip-Top" frame part of the Messrs. Beloit Corporation was introduced on the market, which frame part can be opened in two different stages and which is provided with an articulated joint on top of the combination of rolls, so that an open space cannot be formed directly above the combination of rolls and the press rolls cannot be replaced substantially by direct raising. In this apparatus, the replacement of each the various fabrics requires opening of different parts in the frame part as separate operations.

Various modifications of the "QF frame" have been patented to other parties. Examples of these patents are the U.S. Pat. No. 4,879,002 of Oy Tampella Ab, EP Patent Application 0,348,334 of Beloit Corporation, and U.S. Pat. No. 4,826,572 of Mitsubishi Yukogyo KK.

In these patents, various openable frame parts are suggested, wherein the opening is based either on linear shifting of the intermediate frame parts in the machine direction or on pivoting of said frame parts around a vertical articulated joint.

One problem in the press section of a paper machine concerns vibrations in its frame. These vibrations are formed in the press nips, and they cause variations in the linear loads in the nips. This has a direct detrimental effect on the quality of the paper that is being produced. The vibrations in a press frame are particularly awkward when the vibrations and displacements at the operation side and at the driving side of the frame are of different magnitudes and/or have a phase shift in relation to each other.

OBJECTS AND SUMMARY OF THE INVENTION

An object of the press invention is to provide a press frame construction of a compact press section which is both statically and dynamically better balanced than in prior art.

A further object of the invention is to provide solutions for the problems discussed above so that replacements of the press rolls and fabrics in a compact press section can be carried out advantageously and rapidly in spite of the presence of a rigid press frame system.

It is a further object of the present invention to provide a such a method and a sufficiently rigid frame construction for a press section so that the lowest characteristic frequencies (resonance frequencies) of the vibrations in the frame part can be made higher and the form of vibration more balanced than in the prior art.

It is a further object of the invention to provide such a method and a frame construction of a press section wherein it is possible to use a longer pick-up felt than in prior art, whereby the service life of the felt and the interval of replacement of said felt are made longer. Of course, in a compact press section, in addition to the function referred to in its name, the pick-up felt must also act as a press felt both in the first press nip and in the second press nip.

It is a further object to the present invention to provide such a method and a press section in whose frame system the vibrations and displacements at the operation side and at the driving side have been synchronized so that they are of equal magnitudes and of the same phase, whereby it is possible substantially to reduce the detrimental effects of the vibrations on the press nips and on the paper that is produced.

It is a further object of the invention to provide a method and a press frame construction wherein the objectives dealt with above and a sufficiently rigid press frame construction can be accomplished without increasing the height of the press section.

It is a further object of the invention to provide a method and a press frame construction wherein the tending platforms placed on the compact combination of press rolls in the frame part can be connected with the openable intermediate frame part so that the tending platforms with their handrails need not be disassembled out of the way of replacement of press rolls and fabrics, the objective being to make the replacement of press rolls and press fabrics quicker also in this respect.

In view of the above-mentioned objects and others, the invention is related to a frame construction and method in a compact press section of a paper machine for balancing of its static dynamic properties as well as for replacing of the press rolls and fabrics in which press section the press rolls form a compact combination of rolls, the space in and above said combination of rolls, placed between the front and rear frame parts of the press section, being opened and closed, and by means of which said space at least the upper fabrics and the upper press rolls in the press section are replaced by means of a crane mounted substantially by direct raising and lowering.

The method of the invention comprises interconnecting the front and rear frame parts rigidly at and above the press roll combination by means of a rigid intermediate frame part such that the intermediate frame part is arranged to operate as the frame part of an upper fabric tensioning device of a first upper fabric. The method further comprises arranging the intermediate frame part to be moved such that a free open space is created at and above the press roll combination which can be utilized in the replacement both of the upper press rolls and of the upper fabrics. This is accomplished, for example, by pivoting the intermediate frame part, together with the upper fabric tensioning device and a tensioning roll, around horizontal articulated joints which connect it to the front frame part, or by shifting the intermediate frame part to a side substantially in a clear way so that the open space is created.

The invention also relates to a frame construction of a compact press section, comprising a front frame part and a rear frame part. Certain press rolls in the press section are supported in connection with the front frame part, and at least the press rolls of the last nip or of the latter nips in the press section is supported in connection with the rear frame part. An openable space remains between the frame parts, through which space the press rolls in the compact combination of rolls can be replaced substantially by raising and lowering.

The press section in accordance with the invention is also related to a press frame construction comprising an intermediate frame part coupled in connection with the front frame part by means of horizontal articulated joints or by means of corresponding linear guides from above the compact press roll combination. Means for tensioning of the first upper fabric fitted on said intermediate frame part. The intermediate frame part can be attached to the rear frame part by means of rigid joints, and the intermediate frame part is formed as a rigid unit by means of a transverse support beam or equivalent interconnecting its side parts.

By means of a combined openable intermediate frame part and felt tensioning arrangement in accordance with the invention, the front and rear frames of the press frame construction can be balanced both statically and dynamically.

By virtue of the present method and apparatus of the present invention, the upper felt tensioning roll and the felt tensioning device can be placed at and above the press roll combination, and an increased length and service life are obtained for the pick-up roll, which acts as a press felt in the first nip and in the second nip, whereby the interval of replacement of the fabric can be made substantially longer.

In the invention, the tending platforms with their handrails can be connected with the combined felt tensioning arrangement and pivotal intermediate frame part, whereby these tending platforms can also be brought out of the way for replacement of rolls and felts without separate operations of disassembly. All of the above circumstances together produce considerable advantages so that the quick replacement of the press rolls and the upper press fabrics, which is typical of the afore-mentioned "QF press frames", can be accomplished without increasing the height of the frame part of the press.

BRIEF DESCRIPTION OF THE DRAWINGS

The following drawings are illustrative of embodiments of the invention and are not meant to limit the scope of the invention as encompassed by the claims.

DETAILED DESCRIPTION

Figure 1:
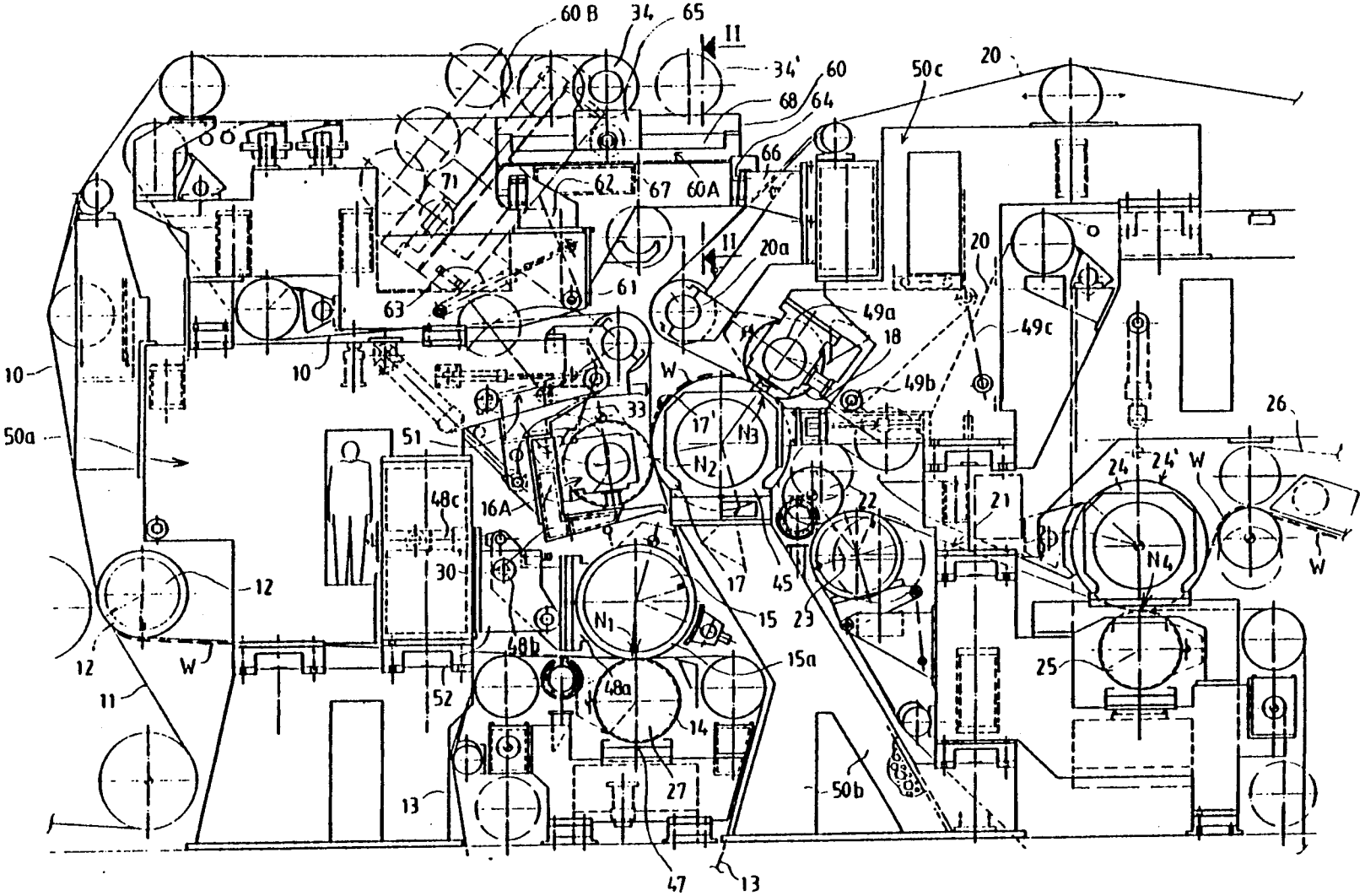
FIG. 1 is a schematic side view of a "Sym-Press 0" press frame construction in accordance with the invention and of a compact press roll combination placed in connection with said frame construction.

The frame construction of the "Sym-Press 0" press section shown in FIGS. 1 to 4 comprises a front frame part 50*a*, a lower intermediate frame part 50*b* and a rear frame part 50*c*. Between the front frame part 50*a* and the rear frame part 50*c*, there is an openable space T, which is utilized for replacement both of the fabrics 10 and 20 and the press rolls 15, 16, 17 and 18. The frame parts 50*a* and 50*c* are interconnected by their top portions, by means of a special intermediate frame part 60 in accordance with the present invention. Frame part 60 is linked in connection with the front frame 50*a* by one end by means of horizontal articulated joints 61. At an opposite end, frame part 60 can be locked by means of rapid connectors 64, in connection with the top of the rear frame part 50*c*.

In connection with the front frame part 50*a*, there is a first upper fabric 10, onto which the paper web W to be dewatered in the press section is transferred from the forming wire 11 by means of the suction zone 12*a* of the pick-up roll 12 and on which fabric 10 the web W is carried into the first and the second nip $N_1$ and $N_2$. The web W is transferred on the lower face of the upper fabric 10 into the first nip $N_1$, which is formed between a hollow-faced lower press roll 14 and an upper press suction roll 15. A lower fabric 13 runs through the nip $N_1$, from which fabric 13 the web W is separated after the first nip $N_1$ by the effect of the suction zone 15*a* of the suction roll 15. The web W follows the first fabric 10 and is passed on the vertical straight run of the fabric 10 into the second nip $N_2$. The second nip $N_2$ is formed between a hollow-faced press roll 16 and the smooth-faced 17' center roll 17 of the press. The suction roll 15 is supported on bearing supports 48*a* which are connected to the projection part 52 of the front frame 50*a* by means of articulated joints 48*b*. The first nip $N_1$ can be loaded and opened by means of hydraulic cylinders 48c fitted between the front frame 50a and the bearing supports 48a.

After the nip $N_2$, the web W adhering to the smooth face 17' of the center roll 17, follows the said roll into the third nip $N_3$, which is formed between the center roll 17 and a hollow-faced press roll 18. The second upper fabric 20 runs through the third nip $N_3$. The guide roll for the second upper fabric, which is placed above the roll combination, is denoted with the reference numeral 20a. The press roll 18 is mounted on bearing supports 49a, which are linked by means of articulated joints 49b in connection with the rear frame 50c. The third nip $N_3$ can be opened and loaded by means of hydraulic cylinders 49c.

After the third nip $N_3$, the web W is detached from the center roll 17 and, being guided by the guide roll 22, is transferred onto the transfer-suction roll 23, over which a lower fabric 21 runs. The web W is transferred on the fabric 21 into a separate fourth nip $N_4$ in the press section. Nip $N_4$ is formed between an upper smooth-faced 24' roll 24 and a lower hollow-faced roll 25. The web W is detached from the roll face 24 and transferred onto the drying wire 26, which carries the web W into the drying section (not shown).

The construction of the press section described above is substantially known in prior art, and it has been described in respect of its principal features only as a background of the invention.

According to the present invention, a particular openable intermediate frame part 60 is fitted above the press roll combination, which is shown in FIG. 1 in the closed position 60A as well as, by dashed lines, in the open position 60B. In its closed position 60A shown in FIG. 1, the intermediate frame part 60 interconnects the front frame part 50a and the rear frame part 50c of the press so that vibrations of the press frames can be reduced as well as so that the vibrations are of the same phase and of equal magnitudes at the operation side and at the driving side of the machine. In view of vibrations, the location of the intermediate frame part 60 is also advantageous in the respect that the frame part is placed as high as possible and far from the largest vibrating masses.

Accordingly to the invention, the intermediate frame part 60 is, at the same time, fitted to operate as the frame part of the tensioning means for the press and pick-up fabric 10. For this purpose, the felt 10 tensioning device 65 is placed on the intermediate frame part 60. Tensioning device 65 is arranged to move by means of a drive gear in its guides 68 parallel to the machine direction. A tensioning roll 34 for the pick-up felt 10 is mounted in connection with the tensioning device 65, the outer extreme position of the roll being denoted with the reference numeral 34'.

As shown in FIG. 1, the upper-felt 10 tensioning roll 34 can be placed at and above the press roll combination 14,15,16,17 and 18, for which reason the length of the upper felt 10 can be increased substantially. From below, the intermediate frame part 60 is connected to flange parts 62, which are placed both at the operation side and at the driving side of the machine and by whose intermediate the frame part 60 is linked with the front frame part 50, both at the operation side and at the driving side of the machine, by means of horizontal pivot shafts 61, from underneath the frame part 60.

In the following, mainly with reference to FIG. 2, a preferred exemplifying embodiment of a combined felt tensioning arrangement and openable intermediate frame part in accordance with the invention will be described.

Figure 2:
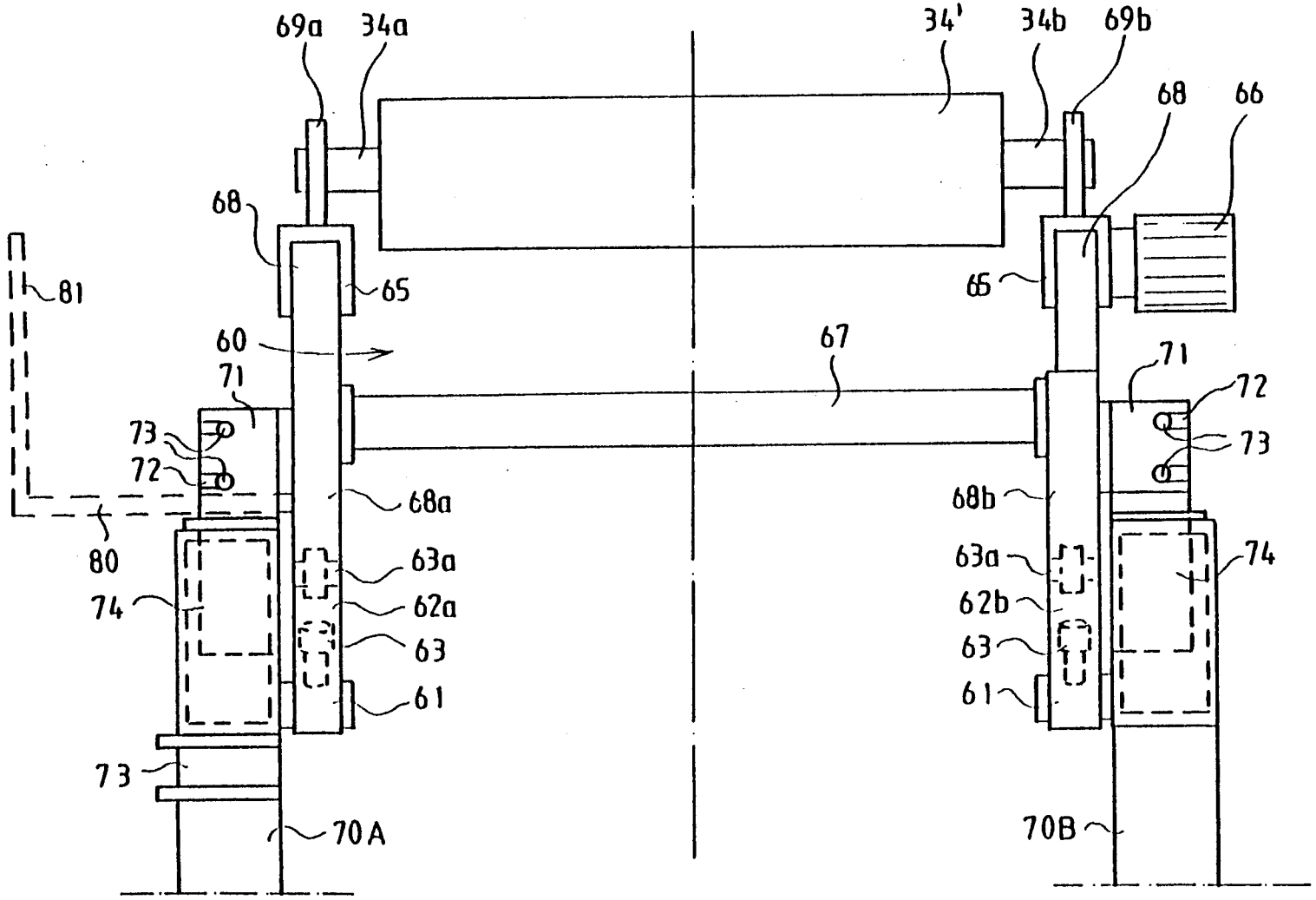
FIG. 2 is a sectional view take along the lines II—II in FIG. 1.

In the vertical sectional view of FIG. 2, the lower side frames 70A at the operation side and the corresponding lower side frames 70B at the driving side are depicted. In connection with the frame 70A at the operation side, there is a detachable intermediate piece 73, which is opened for replacement of the upper fabric 10. Side frames 74 are located above the intermediate piece 73 both at the operation side and at the driving side. On the side frames 74, the combined intermediate frame part and felt tensioning arrangement is mounted by means of horizontal articulated joints 61, to be pivoted by means of hydraulic cylinders 63. This arrangement includes a transverse binder beam 67, which interconnects the projection parts 62a and 62b of the intermediate frame 60. The hydraulic cylinders 63 are connected to said projection parts 62a and 62b by means of articulated joints 63a. The intermediate frame part 60 and the felt tensioning means are provided with guides 68, on which the felt tensioning devices 65 are supported to be shifted by means of a tensioning motor 66. The felt tensioning device 65 are connected with the bearing supports 69a and 69b of the axle journals 34a and 34b of the tensioning roll 34.

In view of locking the combined intermediate frame part 60 and felt tensioning means stably onto the front frame part 50a by means of a fastening more rigid than the articulated joint 61, there are flange parts 71 in connection with the side frames of the intermediate frame part 60 both at the operation side at the driving side of the machine. One flange part 71 is fixed to the front frame 50a and the other flange part 71 is fixed outside the side frames of the intermediate frame part 60.

The flange parts 71 are provided with recesses 72, and the intermediate frame part 60 can be fixed very rigidly in connection with the front frame part 50a by means of eyebolts 73 fitted into said recesses 72. Corresponding fixing in connection with the rear frame part 50c takes place by means of the above openable rapid connectors 64.

The intermediate frame part 60 is very rigid, partly because of its transverse beam 67, so that the intermediate frame part 60 vibrates both at the operation side and at the driving side of the machine at the same rate and with the same amplitude. The rigidity of the whole frame 50,60 is also increased by the robust joints 64 and 71.

In FIG. 2, the tending platforms 80 and their handrails 81 at the operation side of the machine are shown schematically by means of dashed lines. The tending platforms 80 are attached to the side part of the intermediate frame part 60 so that the tending platforms 80 with their handrails 81 are shifted at the same time out of the opened space T and out of the way for replacement of rolls when the intermediate frame part 60 is pivoted to the opened position 60B.

Figure 3:
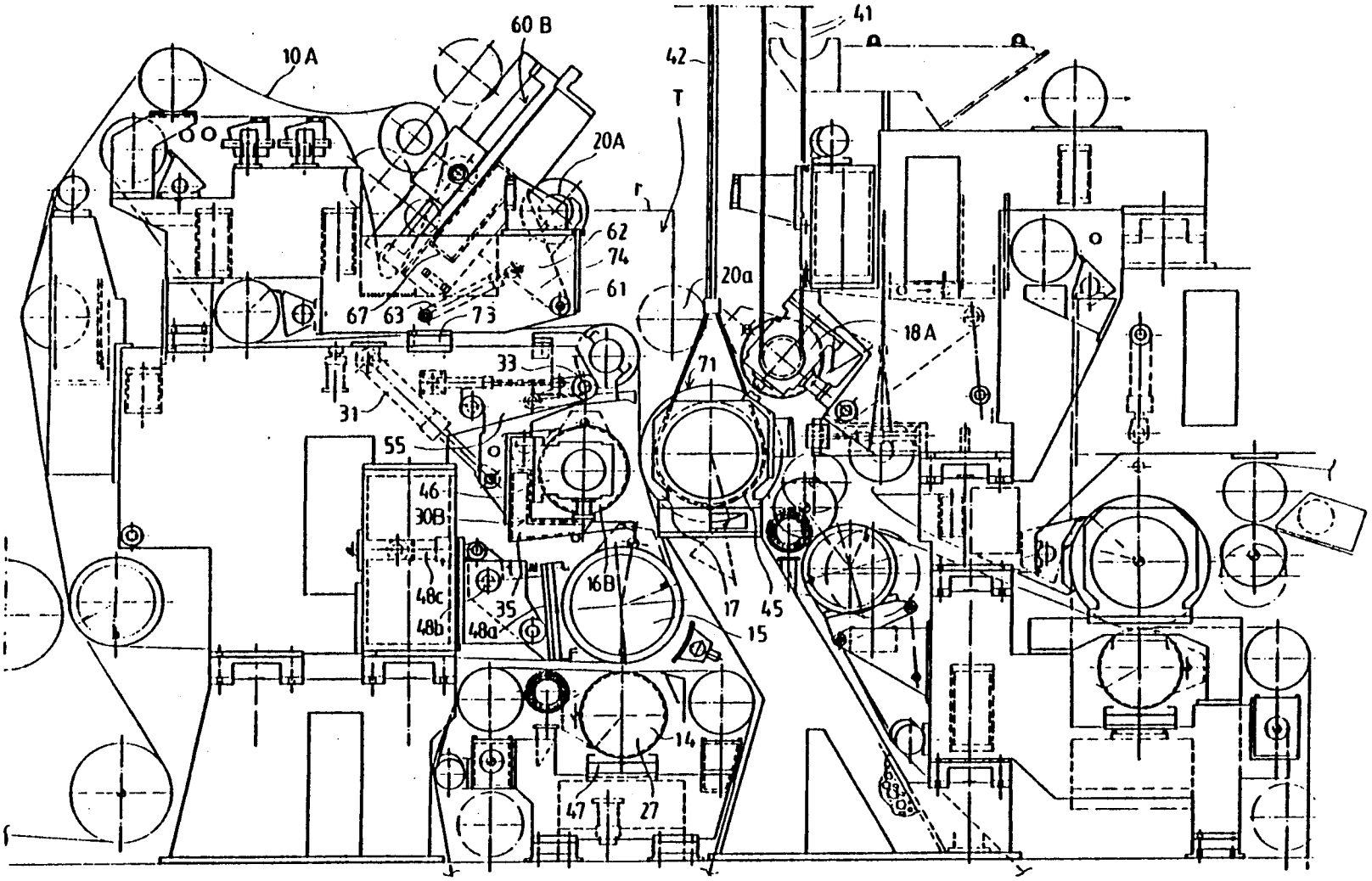
FIG. 3 shows a "Sym-Press 0" press section as shown in FIGS. 1 and 2 with the press frame in the open position and while the upper press rolls are being replaced as well as after the first upper fabric has been removed.

When the rapid connectors 64,71 are opened from the locked position shown in FIGS. 1 and 2, the intermediate frame part 60A closed by means of the pair of hydraulic cylinders 63 can be pivoted to the opened position 60B shown in FIG. 3, whereby the parts 64A and 64B of the rapid connector 64 are separated from each other, and an open free space T is opened above the press roll combination 14,15,16,17,18. This space T is advantageously available for quick replacement of the press fabrics 10 and 20 as well as of the press rolls 15,16,17,18, in the way that will be described in more detail below.

For opening of the second nip $N_2$, its hollow-faced roll 16 can be shifted from the position 16A to an open position. Preferably, there are two such open positions, i.e, the position 16B shown in FIG. 3 and the extreme position 16C shown in FIG. 4. The center roll 17 is mounted on stationary bearing supports 45 on the lower intermediate frame part 50*b*. The mechanism 30 for opening and loading of the press roll 16, which mechanism will be referred to as the support mechanism in the following, for the sake of conciseness, comprises bearing supports 46, which are fixed to the side frames os the support mechanism 30. The mechanism 30 is linked in connection with the projection part 51 of the front frame part 50*a* by the ends of the projection part of the side frames 32 by means of articulated joints 33. The mechanism 30 includes an L-section connection beam 35, which is fixed between the side frames 32.

In the way described above, a rigid support mechanism 30 is formed, which is pivoted around the articulated joints 33 by means of a pair of hydraulic cylinders 31. To the outer side of the horizontal part of the connecting beam 35, a splash plate 40 is attached, which is placed above the suction roll 15 and gives protection against splashes coming from said roll.

In FIG. 3, the support mechanism 30 is shown in its first, slightly opened position 30B in which the nip $N_2$ is open and the roll 16 is in the position 16B. The shifting between the positions 16A and 16B takes place by means of the pair of hydraulic cylinders 31 by pivoting the support mechanisms 30. The support mechanism 30 can be locked in its position 30B shown in FIG. 4, e.g., by means of locking pins.

FIG. 1 shows the operation position of the press section, wherein the Nips $N_1$, $N_3$ and $N_4$ are loaded by their actuators with certain linear loads and dewater the web W. The fourth nip $N_4$ is not always necessary, but the web W may be passed from the center roll 17 directly into the drying section.

In the position shown in FIG. 3, the center roll 17 can be replaced by means of a pair of lifting cables 42 and a crane mounted on the ceiling by direct raising through the opened space T between the frame parts 50*a* and 50*c*, because the opened intermediate frame part 60B is not in its way. As is shown in FIG. 3, the upper roll 18A of the third nip $N_3$ can also be replaced by means of lifting cables 41 and a ceiling crane (not shown) in the paper machine hall.

In the position shown in FIG. 3, it is also possible to replace the first upper fabric 10A and the second upper fabric 20, of which the fabric 10A is shown as removed in FIG. 3. As is shown in FIG. 3, before the center roll 17 is replaced, the guide roll 20*a* of the fabric 20 is shifted along the route r to its parking site into the position 20A above the upper part 74 of the front frame part out of the way for the replacement of the rolls.

Figure 4:
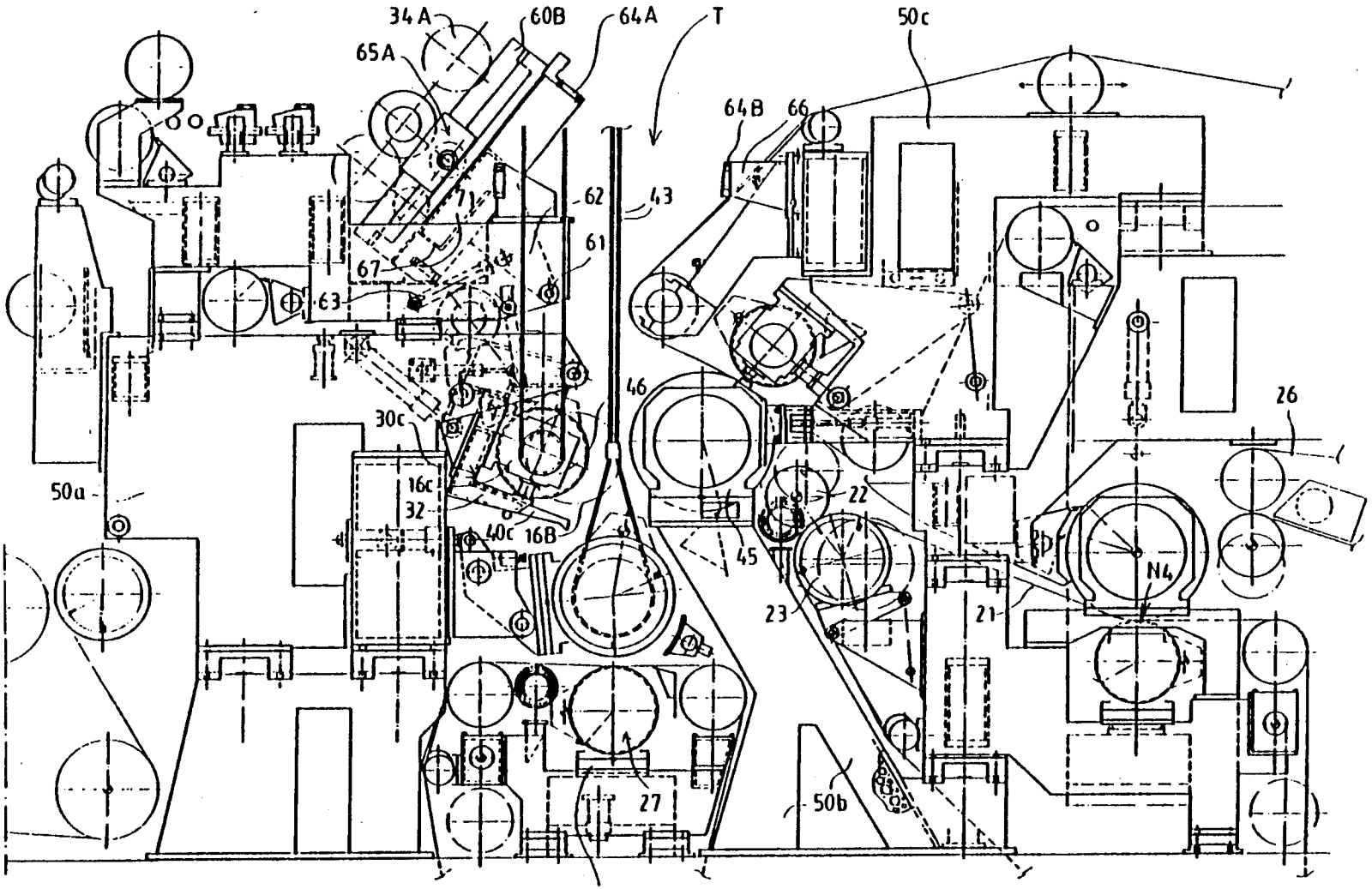
FIG. 4 shows, in a way corresponding to FIG. 3, the press frame in the open position while the center roll in the combination of rolls and the first upper fabric are being replaced.

In FIG. 4, the second open position 30C of the support mechanism 30 is shown, in which position the mechanism is fully opened, in which case the press roll 16 is in the position 16C. The mechanism 30 is supported in the open position 30C shown in FIG. 4 by means of locking pins and holes provided in connection with its side frames 32 and the projection part 51. At the same time as the support mechanism 30 is shifted and locked in the fully opened position 30C shown in FIG. 4, the splash plate is also shifted to the position 40C, where it is not in the way for a replacement of the suction roll 15*a*.

In this position 30C of the support mechanism 30, the suction roll 15*a* of the first nip $N_1$ can be replaced by means of the ceiling crane by using a pair of lifting cables 43 after the center roll 17 has first been removed by means of a pair of lifting cables 42.

The lower press roll 14 in the first nip $N_1$, which is mounted on stationary bearing supports 27, can be replaced by means of a carriage 47 by shifting it in its axial direction and while supporting and shifting the outer, operation-side end of the roll 14 by means of a cable attached to a crane.

After the press rolls and possibly the upper press fabrics 10 and 20 have been replaced, the intermediate frame part 60 is pivoted from the opened position 60B shown in FIG. 4 to the closed position 60A shown in FIG. 1, in which position 60A is locked by means of the rapid connectors 71 and 64 both from the operation side and from the driving side of the machine. In this way, the front frame part 50*a* and the rear frame part 50*c* can be connected as far away as possible from the largest vibrating masses so that the frame becomes very rigid and that the frame vibrates synchronously at its operation side and driving side with a little amplitude.

In the figures, such a preferred embodiment of the invention is illustrated in which the openable intermediate frame part 60 with the felt tensioning means is linked pivotally in connection with the front frame part 50*a*. The invention can, however, also be carried into effect so that the intermediate frame part 60 is made into carriage-like construction, which is supported on glide guides or on rails and wheels to be shifted onto the front frame part 50*a* manually or, preferably, by means of mechanized actuators to the open and closed position and which can be locked rigidly into a closed position on the compact combination of rolls.

Figure 5:
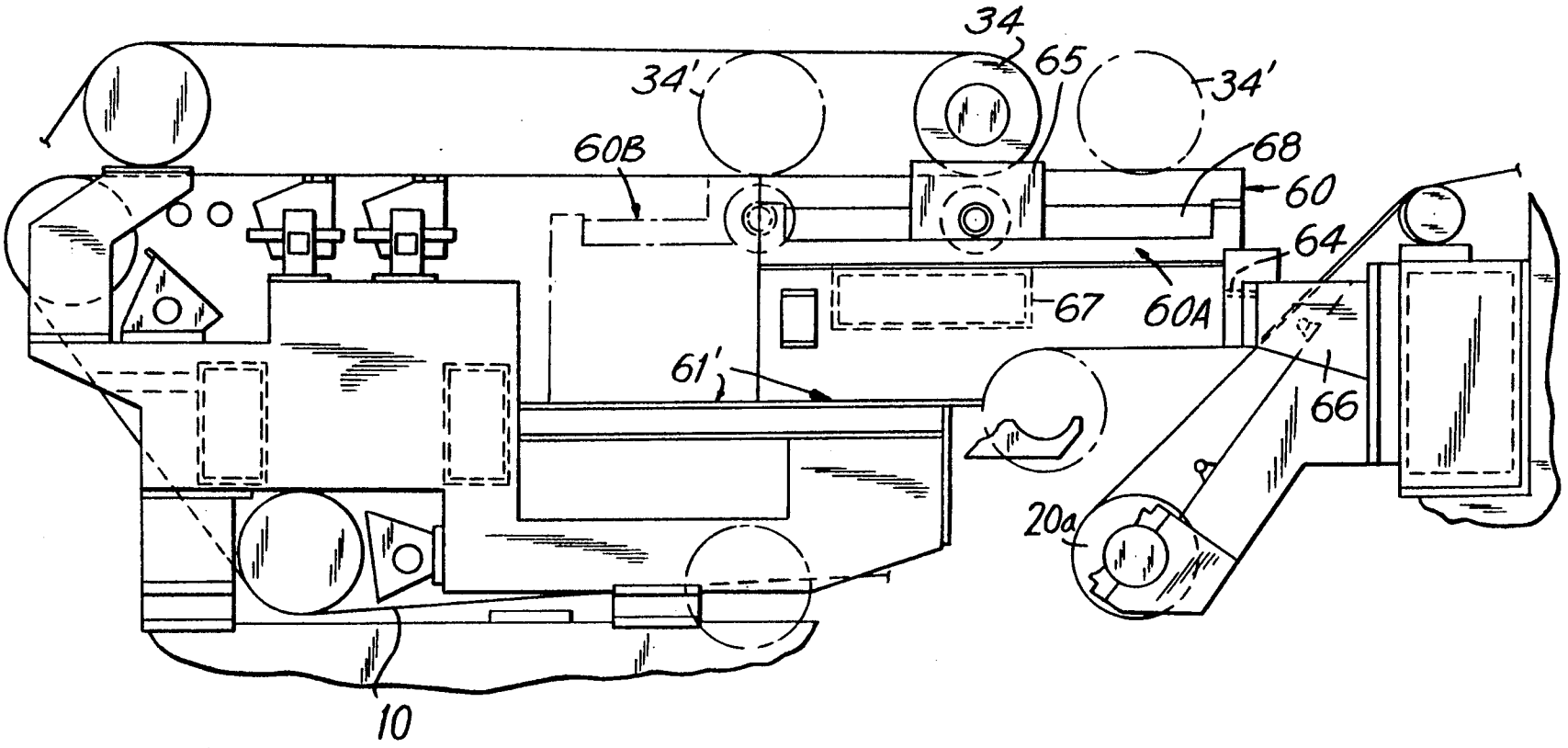
FIG. 5 is an enlarged view of a portion of FIG. 1 showing an embodiment of the invention wherein linear guides are utilized.

One alternative embodiment of the invention, which is usually, however, not an optimal one, is a system in which the intermediate frame part 60 can be shifted into the open position along linear guides on other rear frame part 50*c*. However, before such a shifting, as a rule, the second upper fabric 20 must be removed. Such linear guides are depicted schematically in FIG. 5, wherein the intermediate frame part 60 is shown to be movable via linear guide 61' (presented by two horizontal lines). The intermediate frame part is transferred by linear guide 61' to position 60B (shown in broken lines). Thus, the roll 34 is transferred to position 34'.

The examples provided above are not meant to be exclusive. Many other variations of the present invention would be obvious to those skilled in the art, and are contemplated to be within the scope of the appended claims.

What is claimed is:

1. A method for balancing of its static and dynamic properties as well as for replacing of the press rolls and fabrics in a compact press section of a paper machine, comprising providing a press section having front and rear frame parts and a compact combination of press rolls with a space in and above said combination of rolls, the space being located between said front and rear frame parts of said press section, the space being opened and closed such that at least upper fabrics and upper press rolls in said press section are replaced by means of a crane mounted on the ceiling or equivalent, substantially by direct raising and lowering, rigidly interconnecting said front and rear frame parts at and above said press roll combination by means of a rigid intermediate frame part, arranging said intermediate frame part to operate as the frame part of a tensioning device of a first upper fabric, moving said intermediate frame part together with said tensioning device and a tensioning roll such that the space is opened at and above said press roll combination when any one of upper press rolls and/or upper fabrics are to be replaced.

2. The method of claim 1, further comprising connecting said intermediate to the front frame part via horizontal articulated joints, and pivoting said intermediate frame part together with said tensioning device and said tensioning roll such that the space is opened at and above said press roll combination.

3. The method of claim 2, further comprising attaching said intermediate frame in its closed position to said front frame part by means of rigid openable flange joints in addition to said horizontal articulated joints, and connecting said intermediate frame to an outer end of a projection part in a top portion of said rear frame part by means of rigid openable flange joints.

4. The method of claim 1, further comprising shifting said intermediate frame part together with said tensioning device and said tensioning roll substantially in a linear manner such that the space is opened at and above said press roll combination.

5. The method of claim 1, further comprising placing said tensioning roll which is fixed to said tensioning device on said intermediate frame part at and above said compact combination of rolls.

6. The method of claim 1, further comprising providing a second upper fabric with an associated foremost guide roll of said second upper fabric such that said associated guide roll is placed at and above said combination of press rolls, and shifting said associated guide roll to a parking site out of the way such that the space is opened at and above said press roll combination when any one of upper press rolls and/or upper fabrics are to be replaced.

7. The method of claim 1, wherein said compact press section includes a smooth-faced center roll forming a second press nip with a press roll, comprising supporting said press roll on an opening and loading mechanism, connecting actuators to said opening and loading mechanism such that said second nip is loaded with a suitable linear load and said opening and loading mechanism is pivoted to an open position when any one of upper press rolls and/or upper fabrics are to be replaced, and synchronizing the movement of lateral parts of said opening and loading mechanism with each other by means of a connecting part fitted between them.

8. A press frame construction of a compact press section, comprising a front frame part, a rear frame part, a press roll combination comprising a plurality of press rolls, certain of said press rolls being associated with first and second nips and supported in connection with said front frame part, and other of said press rolls associated with one or more latter nips and supported in connection with said rear frame part, said compact press section including an openable space remaining between said front and rear frame parts through which space the press rolls in the compact combination of rolls can be replaced substantially by raising and lowering by means of a crane mounted on the ceiling or equivalent, a first upper fabric associated with said first frame part for carrying a web into said first and second nip, an intermediate frame part connected to said front frame part, said intermediate frame part being movable to a closed position rigidly connecting said front frame part to said rear frame part, said intermediate frame part being moveable to an open position such that the space above said press roll combination is opened, and means for tensioning said first upper fabric, said tensioning means being located on said intermediate frame part, a tensioning roll supported above said intermediate frame part and connected with said tensioning means.

9. The press frame construction of claim 8, wherein said intermediate frame part is pivotally coupled to said front frame part by means of horizontal articulated joints and said intermediate frame part is attached to said rear frame part by means of rigid joints when said intermediate frame part is in its closed position, said intermediate frame part including side parts and being provided as a rigid unit by means of a transverse support beam interconnecting said side parts.

10. The press frame construction of claim 9, wherein said intermediate frame part further comprises side frames connected with projection parts directed in a downward direction, said horizontal articulated joints being connected with lower ends of said projection parts, and a top portion of said intermediate frame part being provided with guides on which bearing supports of said tensioning roll for said first upper fabric is supported as displaceable in a machine direction.

11. The press frame construction of claim 10, further comprising a pair of hydraulic cylinders connected to said intermediate frame part for moving said intermediate frame part to its opened and closed positions.

12. The press frame construction of claim 11, wherein said intermediate frame part is provided with flange parts connected at a first end of said intermediate frame part and directed in an outward from said side frames of said intermediate frame part, said front frame part being provided with corresponding side frames and corresponding flange parts both at an operation side and at a driving side of said press frame construction, and further comprising rapid connectors for locking said flange parts of said intermediate frame part to said corresponding flange parts of said front frame part such that said intermediate frame part is rigidly connected with said front frame part.

13. The press frame construction of claim 12, further comprising additional flange parts connected to an opposite end of said intermediate frame part and corresponding additional flange parts connected to a projection part located on a top portion of said rear frame part, said additional flange parts being connected to said corresponding additional flange parts when said intermediate frame part is in its closed position, such that said intermediate frame part is rigidly attached to said rear frame part.

14. The press frame construction of claim 8, wherein said means for tensioning said first upper fabric comprises a felt tensioning device provided with guides, said tensioning device being arranged to move in said guides parallel to a machine direction.

15. The press frame construction of claim 8, wherein said intermediate frame part is moved to said open position by means of linear guides leading said intermediate frame part onto said front frame part or said rear frame part.

* * * * *